United States Patent [19]

Tsuji et al.

[11] Patent Number: 4,847,531

[45] Date of Patent: Jul. 11, 1989

[54] WATERPROOFING DEVICE FOR DISPLAY UNIT

[75] Inventors: Katsuya Tsuji; Shun-ichi Futatsuishi, both of Nagasaki, Japan

[73] Assignee: Mitsubishi Denki Kabushiki Kaisha, Tokyo, Japan

[21] Appl. No.: 169,244

[22] Filed: Mar. 16, 1988

[30] Foreign Application Priority Data

Apr. 22, 1987 [JP] Japan ..... 62-100640

[51] Int. Cl.[4] ..... H05B 33/04

[52] U.S. Cl. ..... 313/318; 313/512

[58] Field of Search ..... 313/318, 512; 439/616, 439/617, 619; 362/249, 368, 800

[56] References Cited

U.S. PATENT DOCUMENTS 3,465,197 9/1969 Martin ..... 313/318

FOREIGN PATENT DOCUMENTS 69571 1/1983 European Pat. Off. .

2752049 5/1979 Fed. Rep. of Germany .

2244126 4/1975 France .

14210 of 1912 United Kingdom .

*Primary Examiner*—Kenneth Wieder

*Attorney, Agent, or Firm*—Sughrue, Mion, Zinn, Macpeak & Seas

[57] ABSTRACT

A device for waterproofing a display unit, comprising a display element which is a basic component of the light emission section of a large-sized display equipment; a plug electrically and mechanically connected to the display element; a socket fitted on the plug; a unit case having a display element insertion hole in a portion belonging to the unit case and facing the socket; and an end face seal fitted around the display element insertion hole and located in watertight contact with the unit case and the plug therebetween.

3 Claims, 1 Drawing Sheet

WATERPROOFING DEVICE FOR DISPLAY UNIT

BACKGROUND OF THE INVENTION

The present invention relates to a waterproofing device for the display unit of a large-sized display equipment for providing a large number of people with visual information. FIG. 2 shows a sectional view of a conventional waterproofing devie for a display unit. Shown in FIG. 2 are a display element 1 spherical at the tip thereof and cylindrical at the other portion thereof, a seal pusher 2, a seal 3, a shade 4, a printed circuit board 5 and a socket 6. The seal 3 is pinched between the seal pusher 2 and the shade 4 so that the seal is compressed in the direction of the thickness thereof and expanded perpendicularly to the direction. The tightness of the contact of the display element 1 and the seal 3 is thus increases. The shade 4 prevents raindrops from rushing in between the display element 1 and the seal 3. The seal 3 functions so that the raindrops whose rushing motion is stopped by the shade 4 are completely prevented from entering into the display unit.

Since the display element 1 is cylindrical, the conventional waterproofing device can perform a proper waterproofing function. However, as for a display element whose cross section is angular and whose tip is thicker than the butt thereof, a high tightness of contact is not attained by the conventional waterproofing device, so that the device cannot perform a sufficient waterproofing function. This is a problem.

The present invention was made in order to solve the above-mentioned problem.

Accordingly, it is an object of the present invention to provide a waterproofing device for a display unit, which performs a sufficient waterproofing function and has a simple construction.

SUMMARY OF THE INVENTION

In the waterproofing device provided in accordance with the present invention, an end face seal having fins is fitted around a display element insertion hole; the joint of the electrode of a display element and a plug is sealed; and the plug and a socket are fitted to each other so that they are engaged with each other not to be easily disengaged from each other.

The end face seal having the fins is located in tight contact with the plug so as to prevent raindrops from coming in.

DETAILED DESCRIPTION OF THE PREFERRED EMBODIMENT

Figure 1:
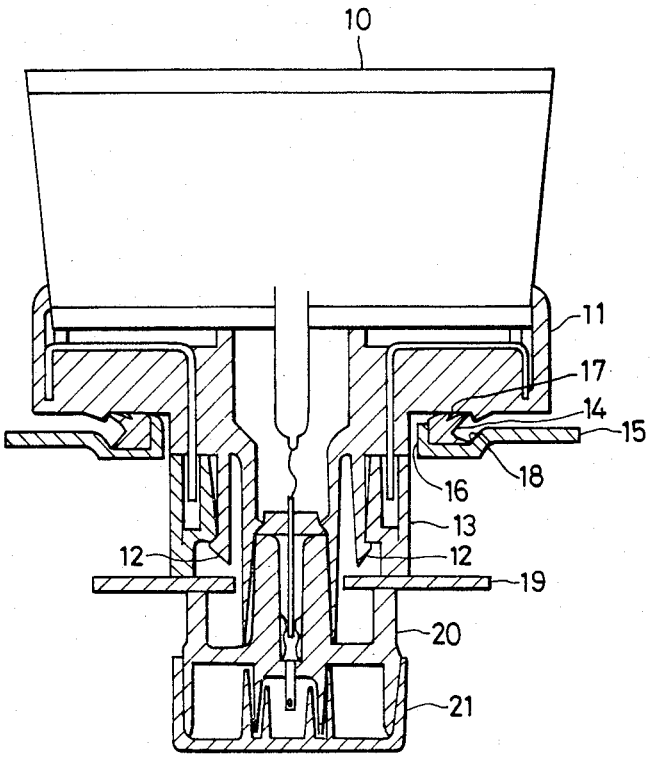
FIG. 1 shows a sectional view of a waterproofing device, which is an embodiment of the present invention, for the display unit of a large-sized outdoor display equipment.
Figure 2:
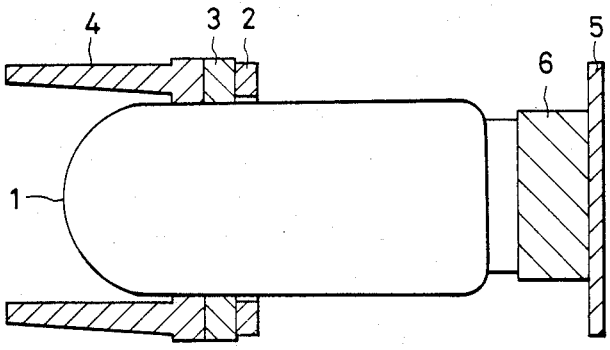
FIG. 2 PRIOR ART
FIG. 2 shows a sectional view of a conventional waterproofing device for a display unit.

An embodiment of the present invention, which is a waterproofing device, is hereafter described with reference to FIG. 1 showing a display element 10 whose cross section is angular, a plug 11 connected at a portion thereof to the electrode of the display element, sealed at the portion and fitted with an engaging pin 12, a socket 13 fitted with the plug 11, an end face seal 14 whose inside diameter is smaller than the outside diameter of a display element insertion hole 16 provided in a unit case 15 to insert the display element in the hole, two fins 17 provided on the end face seal, the unit case 15 having a groove 18 around the insertion hole 16 to fit the end face seal in the groove, a printed circuit board 19, a highvoltage socket 20, and a cover 21.

The operation of the waterproofing device is now described. Since the inside diameter of the end face seal 14 is smaller than the outside diametr of the display element insertion hole 16 of the unit case 15, the end face seal is kept in tight contact with the unit case. When the plug 11 is completely fitted on the socket 13, the plug 11 and the end face seal 14 are put in tight contact with each other. Although the end face seal 14 exerts a force to push back the plug 11, the end face seal and the plug 11 are kept in tight contact with each other because the plug is provided with the engaging pin 12. Raindrops entering on the side surface of the display element 10 are completely stopped by the two fins 17. Raindrops entering on the unit case 15 are stopped by the fin 17 located in contact with the unit case 15.

Although the end face seal 14 is provided around the insertion hole 16 for the display element 10 in the above-described embodiment, the present invention is not confined thereto but may be otherwise embodied so that an O-ring is provided instead of the end face seal.

According to the present invention, a waterproofing device is provided with an end face seal around a display element insertion hole. For that reason, it is easy to construct the waterproofing device, and highly-reliable waterproofing is enabled.

We claim:

1. A device for waterproofing a display unit, comprising a display element; a plug electrically and mechanically connected to the display element; a socket fitted on the plug; a unit case having a display element insertion hole and a groove circumscribing said insertion hole, said plug being insertable into said insertion hole; and an end face seal disposed in said groove so as to circumscribe the display element insertion hole such that said end face seal is located between the unit case and the plug in watertight contact therewith.

2. The waterproofing device of claim 1, wherein the inside diameter of said face seal is smaller than the diameter of said insertion hole.

3. The waterproofing device of claim 1, wherein said plug is fitted to said socket by substantially L-shaped engaging pins which engage said socket.

* * * * *